United States Patent [19]

Altmann

[11] 4,061,374

[45] Dec. 6, 1977

[54] WIDTH-MAINTAINING CYLINDER

[75] Inventor: Jack G. Altmann, Tann-Rueti, Switzerland

[73] Assignee: G. Hunziker AG, Rueti, Switzerland

[21] Appl. No.: 694,711

[22] Filed: June 10, 1976

[30] Foreign Application Priority Data

June 24, 1975 Switzerland ..... 8217/75

[51] Int. Cl.[2] ..... B65H 17/20

[52] U.S. Cl. ..... 308/1 R; 26/97; 226/194

[58] Field of Search ..... 308/36, 182, 3 R; 26/83, 88, 89, 97, 98, 99, 100; 226/190, 194

[56] References Cited

U.S. PATENT DOCUMENTS

| | | | |
|---|---|---|---|
| 459,203 | 9/1891 | Hollingworth | 26/97 |
| 479,501 | 7/1892 | Goddard | 26/100 |
| 2,639,483 | 5/1953 | Wester | 26/97 X |

*Primary Examiner*—Joseph F. Peters, Jr.
*Assistant Examiner*—Gene A. Church
*Attorney, Agent, or Firm*—Blanchard, Flynn, Thiel, Boutell & Tanis

[57] ABSTRACT

A width-maintaining cylinder having at least one bearing arranged on a support at an angle to the longitudinal axis thereof. The bearing has a flange and a circular cylinder bearing surface for a small wheel set at an angle. The bearing has contact surfaces on both sides and can be clamped on the support between two tensioning elements. The contact surfaces of the bearing which can be pressed against one another are at right angles to the longitudinal axis of the support.

8 Claims, 9 Drawing Figures

WIDTH-MAINTAINING CYLINDER

FIELD OF THE INVENTION

The invention relates to a width-maintaining cylinder having at least one bearing arranged on a support at an angle to the longitudinal axis, the bearing having a flange and a circular-cylindrical bearing surface for a small wheel set at an angle, wherein the bearing has contact surfaces on both sides and can be clamped on the support between two tensioning elements.

BACKGROUND OF THE INVENTION

Width-maintaining cylinders are used in textile machines, especially in weaving machines or in machies for inspecting cloth. These width-maintaining devices have the function of guiding the fabric on the weaving machine so that it always has a constant width.

In this process the inclined wheels of the width-maintaining cylinder have spikes on their outer periphery which catch in the fabric, constantly push the fabric outwards as the wheels are turning, and then detach themselves again from the fabric.

The width-maintaining cylinders are located on both sides of the weaving machine and ensure that the fabric produced is held at a constant width.

FIG. 1A shows shematically a weaving machine. From the warp beam 1 the warp threads are guided over the carding beam 2, through the strand eyelets 3 of the shafts 4. After passing through the plate 5 they are crossed with the shuttle thread carried in the weaving shuttle 7. This operation causes the formation of the fabric. This fabric passes over the breast beam 9 to the goods beam 6. As apparent, during the manufacture of the fabric, the web of fabric is held at the same width by width-maintaining cylinders which are located on both sides of the weaving machine, so that a taut shape is produced.

FIG. 1B shows a conventional width-maintaining cylinder. Width-maintaining cylinders of known type have the drawback that owing to their construction they have the inevitable tendency to distort as they are being fitted into the weaving machine. This inevitable tendency to distortion is described below with reference to FIG. 1C of the drawings.

According to FIG. 1C the width-maintaining cylinder has a support 10 which is provided at its free end with a closed cap 11 as tensioning element, and at its other end with a thread 12. A number of bearings 13 are arranged next to one another on the support 10. Each bearing is provided with a flange 14 and a small wheel 15 is rotatably mounted on each bearing. The small wheels 15 are provided with spikes 16. Instead of spikes, rubber rings 17 also many be used which likewise draw the fabric outwards through friction and thus hold it at a constant width.

The contact surface 20 of a bearing 13 to the flange 14 of the adjacent bearing is at an angle to the longitudinal axis of the support 10.

The width-maintaining cylinder is secured through an opening by a nut 19 to the weaving machine 18.

By tightening the nut 19 the bearings 13 with the flanges 14 are pushed together via a tapered washer 52, resulting in an axial tensioning force $P_v$. The magnitude of the tensioning force is dependent on the diameter of the support 10, on the type of thread 12, on the friction coefficients of the nut 19 on the surface of the weaving machine 18 and on the tightening torque with which the nut 19 is tightened. Practical findings have shown that the tensioning force $P_v$ in the case of width-maintaining cylinders having a support diameter of 8 mm is approximately 800 to 1,000 kiloponds.

The axial tensioning force $P_v$ is divided into a normal force $P_N$ and into a shearing force $P_Q$. The shearing force $P_Q$ is about 300 kiloponds when the flange 14 is inclined at 70° to the longitudinal axis of the support 10. Since the resistance to bending of the support 10 is smaller than the shearing force $P_Q$ (about 1/5th), a distortion of the part 10 and thus of the width-maintaining cylinder is inevitably produced so that its ability to function is no longer guaranteed under all circumstances.

It is the task of the present invention to provide a width-maintaining cylinder of the type referred to initially which, with a simple construction, ensures in every case that regardless of the tensioning force as the tensioning elements are tightened, a distortion of the width-maintaining cylinder can be prevented satisfactorily.

This problem is solved according to the invention in that the contact surfaces of the bearing which can be pressed against one another are at right angles to the longitudinal axis of the support 10. This produces the advantage that when tightening the nut, an axial tensioning force is produced which is effective at right angles upon the contact surfaces which may be pressed against one another. Thus no forces $P_N$ and $P_Q$ occur which could lead to a distortion of the width-maintaining cylinder. Thus in every case the complete functional reliability of the width-maintaining cylinder is ensured, regardless of the tightening torque of the tensioning elements.

Further advantages and features of the present invention are apparent from the sub-claims and from the following description of the figures.

BRIEF DESCRIPTION OF THE DRAWINGS

The invention is described in more detail below with reference to the embodiments shown in the drawing. In the drawings

DETAILED DESCRIPTION

Figure 1A:
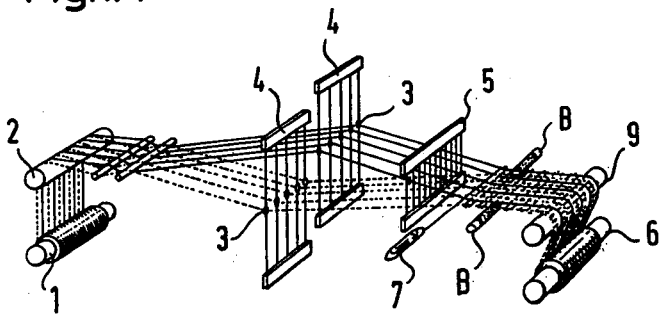
FIGS. 1A-1C are prior art described above.
Figure 1B:
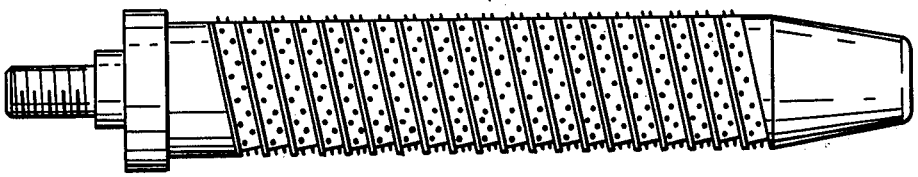
Fig.1B PRIOR ART
Figure 1C:
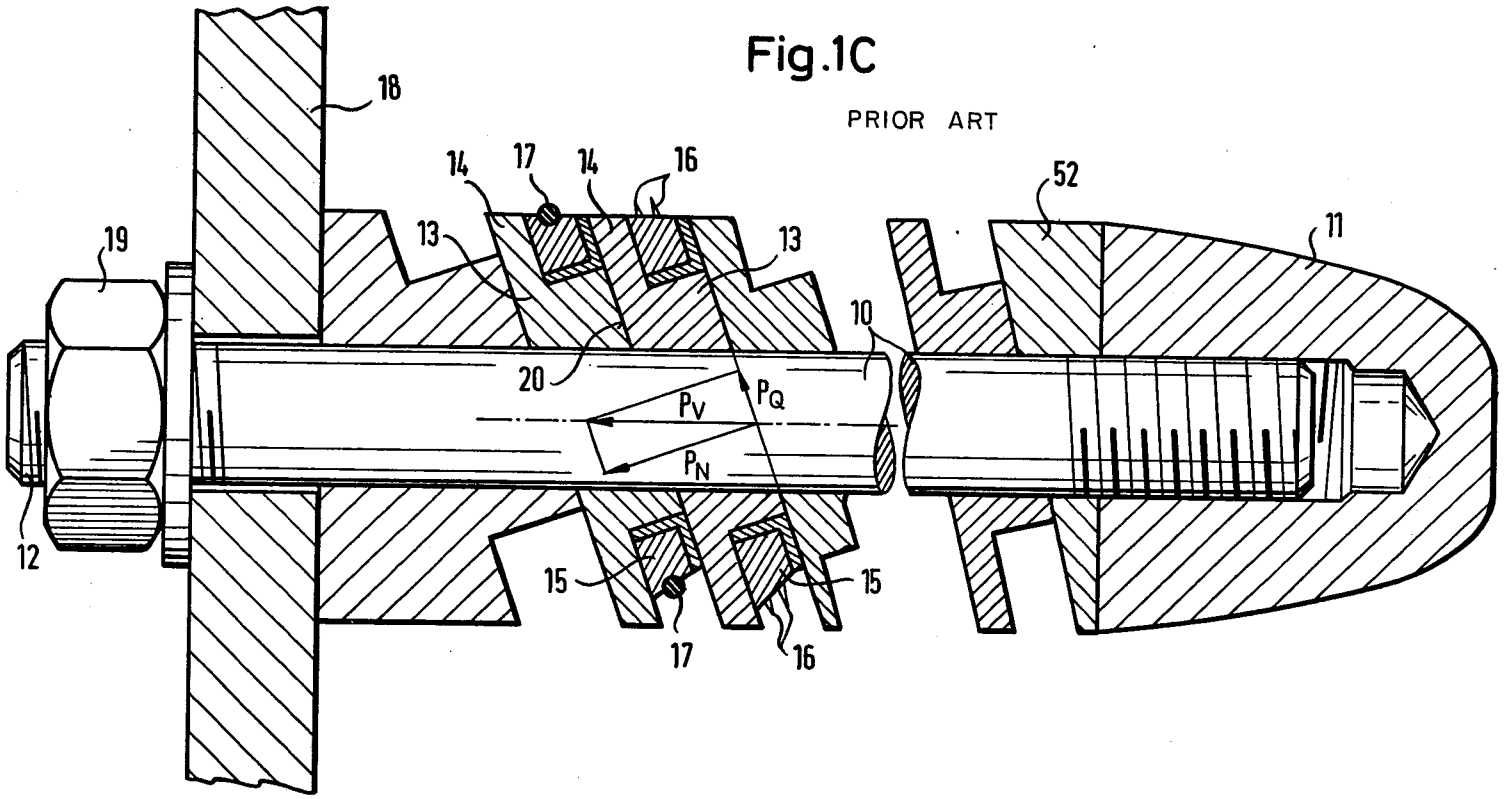
Fig.1C PRIOR ART
Figure 2:
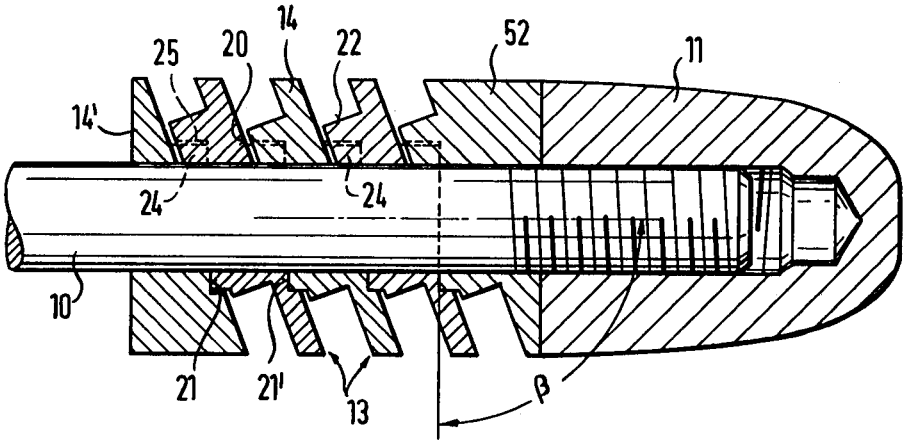
FIG. 2 shows a side view of the middle section of the inventive width-maintaining cylinder in one embodiment.

According to FIG. 2 the bearings 13 are situated on the support 10 of the width-maintaining cylinder between the tensioning elements 14' and 11 and 52.

These bearings 13 are set at an angle to the longitudinal direction of the support 10 and have a flange 14 and also a circular cylindrical bearing surface 22 for mounting a small wheel set at an angle.

Figure 4:
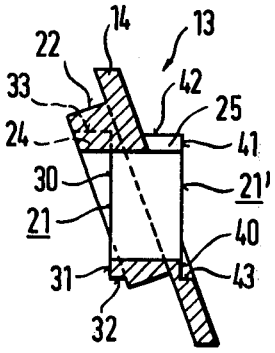
FIG. 4 shows a section along the line IV—IV of FIG. 3.

The bearing 13 shown in more detail in FIG. 4, has on one side a contact surface 21 and on the other side a contact surface 21'. Both contact surfaces 21 and 21' are at right angles to the longitudinal axis of the support 10.

The one contact surface 21 has a part 30 which is situated inside the inclined circular cylindrical bearing surface 22. In the lower area another part 31 projects beyond this bearing surface 22. The part 30 has a peg 24.

On account of the recessed part 30 and the projecting part 31 of the contact surface 21, cylindrical shapes are produced, that is, in the lower part, the cylindrical section 32 and in the upper part the cylindrical recess 33. On the other side of the bearing there is the contact surface 21'. This contact surface 21' has a part 40 which is partially recessed in the inclined flange 14. In addition, the contact surface 21' also has a part 41 in its upper area which projects beyond the inclined flange 14. The projecting part 41 forms a cylindrical section 42 with respect to the cylindrical flange 14, whilst the part 40 recessed in the flange 14 forms a cylindrical recess 43.

Figure 3:
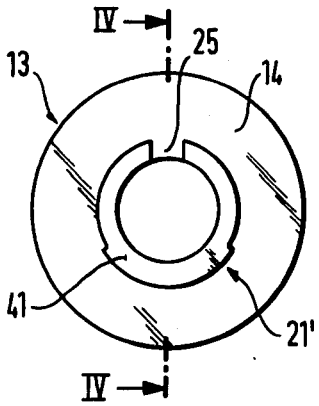
FIG. 3 shows a front view of a bearing.

As may be seen from FIGS. 3 and 4, the cylindrical section 42 is interrupted in its upper area by a recess 25.

Owing to the above-mentioned constructive development, it is possible to fit adjacent bearings 13 into one another; in this operation the projecting part 31 of one bearing engages in the recessed part 40 of the adjacent bearing (lower area) whilst in the upper area, the part 30 of the first bearing engages in the part 41 of the adjacent bearing. As a result, the peg 24 of the one bearing 13 engages in the recess 25 of the adjacent bearing so that satisfactory protection against rotation is ensured.

In the above-mentioned manner, any number of bearings can be fitted one against the other, an operative connection of the contact surfaces 21 and 21' of one bearing with the contact surfaces 21 and 21' respectively of the adjacent bearing thus being always guaranteed. When tightening the tensioning elements, it is thus satisfactorily guaranteed that a distortion of the width-maintaining cylinder will be avoided. According to FIG. 2 the faces 20, which are inclined, thus do not form contact points, the contact being produced by the abovementioned contact surfaces 21 and 21'.

According to FIG. 2, the contact surfaces 21 and 21' are at an angle $\beta$ with respect to the longitudinal axis of the support 10, the angle $\beta$ being always 90°, regardless of the inclination of the bearing 13, the flange 14 and the small wheels mounted on the circular cylindrical bearing surfaces 22.

When tightening a nut, an axial tensioning force $P_y$ is produced. Since the tensioning force is effective at right angles upon the contact surfaces 21 and 21' the disadvantageous force components $P_N$ and $P_Q$ are avoided. The width-maintaining cylinder can thus advantageously no longer become distorted.

Figure 5:
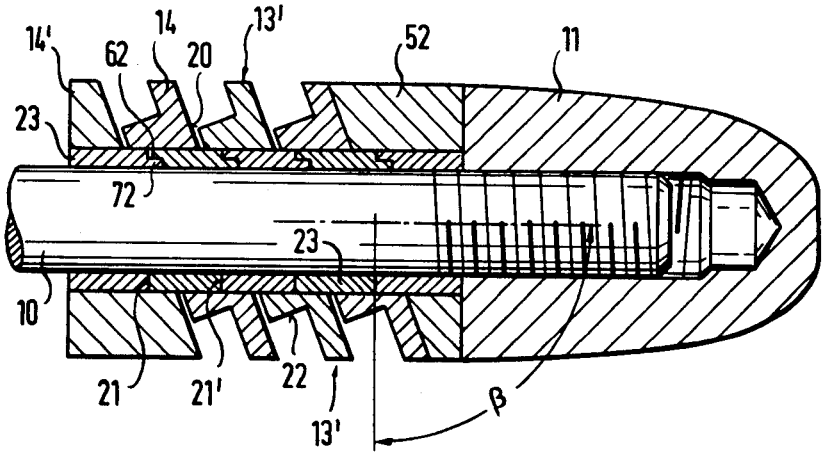
FIG. 5 shows another possible embodiment of the inventive width-maintaining cylinder.
Figure 6:
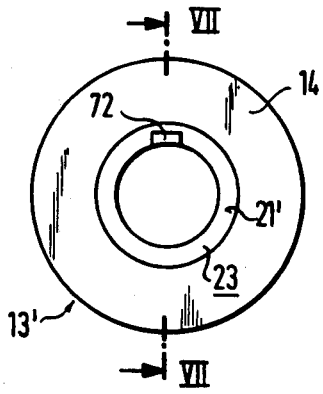
FIG. 6 shows a front view of a bearing according to the embodiment of FIG. 5.
Figure 7:
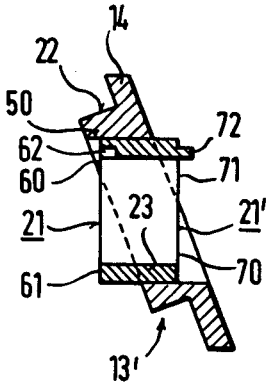
FIG. 7 shows a section along the line VII—VII of FIG. 6.

In FIGS. 5, 6 and 7 another possible embodiment of the inventive width-maintaining cylinder is illustrated. According to FIG. 7, a tube 23 is pressed into the bearing opening 50 of the bearing 13'. The tube 23, the bearing 13' and the flange 14 thus form one unit.

Again, the tube 23 has contact surfaces 21 and 21' running at right angles to the longitudinal axis of the support 10. As apparent from FIG. 7, the contact surface 21 forms a recessed part 60 in its upper area and a projecting part 61 in its lower area. On the side of the flange 14, the contact surface 21' forms a recessed part 70 and a projecting part 71. According to FIGS. 6 and 7, the projecting part 71 is provided with a peg 72.

The recessed part 60 of the contact surface 21 has a recess 62.

Again it is possible to fit adjacent bearings 13' against one another owing to the recessing of parts 60, 61 on the one hand and of 70, 71 on the other hand. In this operation, the peg 72 of the one bearing 13' engages in the recess 62 of the adjacent bearing. Again complete assurance is given that the adjacent bearings 13' are pressed together at an angle of 90° to the longitudinal axis of the support 10 by means of the tensioning elements 14' and 11 and 52 respectively. (cf. FIG. 5).

Whereas in the embodiment according to FIGS. 2 to 4 the bearing 13 consists of one part, in the embodiment according to FIGS. 5 to 7 the bearing 13' consists of two parts, wherein the tube 23 is pressed into the bearing 13'. In both cases however, owing to the contact surfaces 21 and 21', it is ensured that the tensioning force is effective at right angles upon the contact surfaces. The inclined face 20 shown in FIG. 5 is thus excluded from being effective, so that regardless of the inclination of the circular cylindrical bearing surfaces 22 and of the small wheels mounted on them, an efficient tensioning of the bearing 13 can be effected without a detrimental distortion of the width-maintaining cylinder occuring.

The embodiments of the invention in which an exclusive property or privilege is claimed are defined as follows:

1. In a width-maintaining cylinder having at least one bearing arranged on a support at an angle to the longitudinal axis, the bearing having a flange and a circular cylindrical bearing surface for a small wheel set at an angle, wherein the bearing has contact surfaces on both sides and can be clamped on the support between two tensioning elements, the improvement comprising wherein the contact surfaces of the bearing, which can be pressed again one another, are at right angles to the longitudinal axis of the support.

2. The improved width-maintaining cylinder according to claim 1, wherein on the one side of the bearing, a part of the contact surface at right angles to the longitudinal axis of the support is arranged inside an inclined circular cylinder bearing surface and another part projects beyond this bearing surface and wherein on the other side of the bearing, the contact surface partially projects beyond an inclined flange and is partially recessed therein, wherein the one contact surface is joined to the inclined circular cylinder bearing surface and the other contact surface is joined to the inclined flange by means of cylindrical sections.

3. The improved width-maintaining cylinder according to claim 1, wherein the cylindrical section in the area of the inclined flange of one bearing engages in a cylindrical recess in the area of the inclined, circular cylindrical bearing surface of the adjacent bearing, and wherein a cylindrical recess in the area of the inclined flange engages in the cylindrical section in the area of the inclined circular cylindrical bearing surface of the adjacent bearing.

4. The improved width-maintaining cylinder according to claim 1, wherein the one part of the contact surface has a peg and the other part has a recess wherein when the width-maintaining cylinder is in its assembled state, the peg of the one bearing engages in the recess of the adjacent bearing.

5. The improved width-maintaining cylinder according to claim 1, wherein the bearing with the flange and the contact surfaces consist of one part.

6. The improved width-maintaining cylinder according to claim 1, wherein the bearing with the flange consists of one part wherein a tube with the two contact surfaces is pressed into a bearing opening.

7. The improved width-maintaining cylinder according to claim 6, wherein the tube has recessed and projecting parts in the area of the two contact surfaces.

8. The improved width-maintaining cylinder according to claim 6, wherein one projecting part of the bearing has a peg and the opposite recessed part has a recess.

* * * * *